US008915098B2

(12) United States Patent
DiFoggio

(10) Patent No.: US 8,915,098 B2
(45) Date of Patent: Dec. 23, 2014

(54) DOWNHOLE REFRIGERATION USING AN EXPENDABLE REFRIGERANT

(75) Inventor: Rocco DiFoggio, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 169 days.

(21) Appl. No.: 13/450,898

(22) Filed: Apr. 19, 2012

(65) Prior Publication Data

US 2013/0104572 A1 May 2, 2013

Related U.S. Application Data

(60) Provisional application No. 61/485,210, filed on May 12, 2011.

(51) Int. Cl.

| | |
|---|---|
| ***F25D 3/12*** | (2006.01) |
| ***E21B 36/00*** | (2006.01) |
| ***F25D 7/00*** | (2006.01) |

(52) U.S. Cl.

CPC ..... *F25D 7/00* (2013.01); *E21B 36/001* (2013.01)

USPC ..... 65/56; 62/260

(58) Field of Classification Search

CPC ..... F25D 7/00; F25D 15/00; E21B 36/001; E21B 47/00

USPC ..... 62/56, 259.4, 260, 259.2

See application file for complete search history.

(56) References Cited

U.S. PATENT DOCUMENTS

| | | | | |
|---|---|---|---|---|
| 3,004,601 | A * | 10/1961 | Bodine | 166/302 |
| 4,224,805 | A * | 9/1980 | Rothwell | 62/260 |
| 4,248,298 | A * | 2/1981 | Lamers et al. | 166/57 |
| 4,474,238 | A * | 10/1984 | Gentry et al. | 166/268 |
| 4,805,407 | A | 2/1989 | Buchanan | |
| 5,265,677 | A | 11/1993 | Schultz | |
| 5,701,751 | A | 12/1997 | Flores | |
| 5,738,164 | A * | 4/1998 | Hildebrand | 165/45 |
| 6,321,561 | B1 * | 11/2001 | Maget | 62/498 |
| 6,341,498 | B1 | 1/2002 | DiFoggio | |
| 6,550,530 | B1 | 4/2003 | Bilski | |
| 6,672,093 | B2 | 1/2004 | DiFoggio | |
| 6,769,487 | B2 | 8/2004 | Hache | |
| 6,877,332 | B2 | 4/2005 | DiFoggio | |
| 6,978,828 | B1 | 12/2005 | Gunawardana | |
| 7,124,596 | B2 | 10/2006 | DiFoggio et al. | |
| 7,428,925 | B2 | 9/2008 | Brown et al. | |
| 7,568,521 | B2 | 8/2009 | Brown et al. | |
| 7,748,265 | B2 | 7/2010 | Reid et al. | |
| 7,793,712 | B2 | 9/2010 | Yamate et al. | |
| 7,832,220 | B1 * | 11/2010 | Wiggs | 62/77 |
| 2004/0112601 | A1 | 6/2004 | Hache | |
| 2010/0206549 | A1 | 8/2010 | Dowling et al. | |

OTHER PUBLICATIONS

High Pressure Equipment Company, High Pressure Equipment, Sep. 2004, pp. 41-4.A, Erie PA, USA.

(Continued)

*Primary Examiner* — Mohammad M Ali

(74) *Attorney, Agent, or Firm* — Cantor Colburn LLP

(57) ABSTRACT

Cooling of downhole components is effected using an expendable refrigerant, such as water. Refrigerant, in thermal communication with a component to be cooled, is evaporated in an evaporator. Vapor is removed from the evaporator and released into a borehole, in order to cool the component. A pump may be used to remove the vapor from the evaporator and force the vapor into the borehole.

20 Claims, 3 Drawing Sheets

(56) References Cited

OTHER PUBLICATIONS

Kilicarslan, et al. COPs of R718 in Comparision with Other Modern Refrigerants, Proceedings of the First Cappadocia International Mechanical Engineering Symposium, Jul. 14-16, 2004, pp. 317-323, Cappadocia, Turkey.

Bennett, "Active Cooling for Downhole Instrumentation: Preliminary Analysis and System Selection". LA—11102-MS, UC-66b, Mar. 1988. Los Alamos National Laboratory. 147 pages.

Notification of Transmittal of the International Search Report and the Written Opinion of the International Searching Authority, or the Declaration; PCT/US2012/037454; Nov. 20, 2012.

* cited by examiner

DOWNHOLE REFRIGERATION USING AN EXPENDABLE REFRIGERANT

CROSS REFERENCE TO RELATED APPLICATIONS

This application claims the benefit of an earlier filing date from U.S. Provisional Application Ser. No. 61/485,210 filed May 12, 2011, the entire disclosure of which is incorporated herein by reference.

BACKGROUND

Equipment in a borehole is often subjected to conditions that threaten proper operation. Temperatures are often 450° F. and can reach 600° F. Cooling of such equipment is therefore desirable. A number of prior cooling systems have been used, but further improvement is desirable.

SUMMARY

In one embodiment a method for cooling a downhole component is disclosed. A refrigerant in thermal communication with the component is evaporated in an evaporator. At least a portion of the refrigerant is evaporated to form refrigerant vapor in order to cool the component. The refrigerant vapor is then conveyed from the evaporator to a borehole.

Another embodiment is an apparatus for cooling a downhole component. An evaporator is in thermal communication with the downhole component. The evaporator contains an expendable refrigerant that vaporizes responsive to heat of the downhole component. An element is configured to remove refrigerant vapor from the evaporator and release removed refrigerant into a borehole.

Objects and advantages will become apparent in the following.

BRIEF DESCRIPTION OF THE DRAWINGS

Referring now to the drawings wherein like elements are numbered alike in the several figures.

DETAILED DESCRIPTION

A detailed description of one or more embodiments of the disclosed apparatus and method is presented herein by way of exemplification and not limitation with reference to the Figures.

Figure 1:
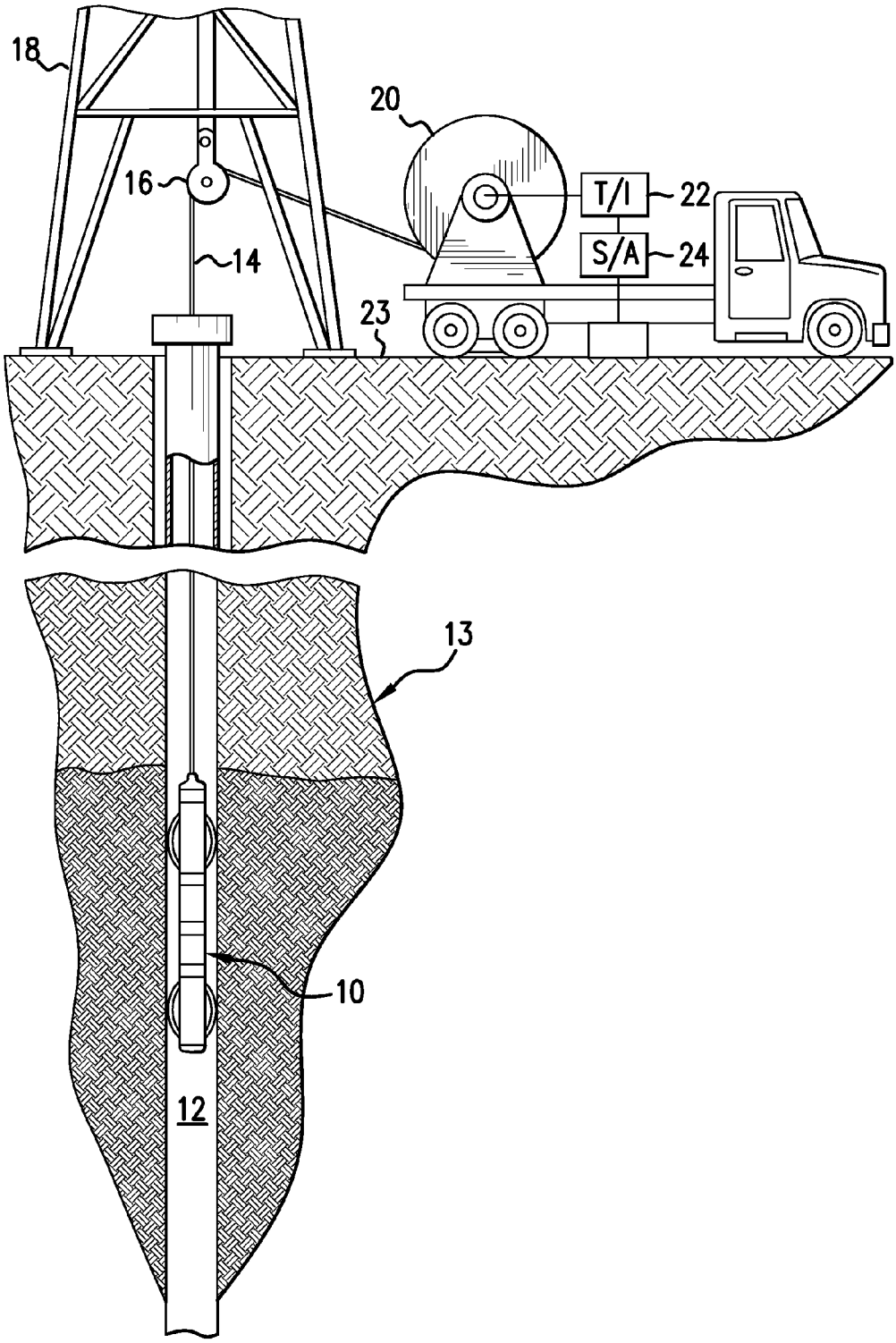
FIG. 1 illustrates a vertical section of a rig including downhole equipment that may benefit from cooling.

FIG. 1 is a vertical section of an example of a rig including downhole equipment that might benefit from cooling. A tool 10 is suspended in a borehole 12 that penetrates an earth formation 13. The tool is suspended from a suitable cable 14, also referred to as a carrier, that passes over a sheave 16 mounted on a drilling rig 18. By industry standard, the cable 14 provides power to, support for, and data transmission to and from the tool 10. Draw works 20 raise and lower the tool 10. Electronic module 22, on the surface 23, transmits operating commands downhole and receives data back. The data may be recorded on an archival storage medium of any desired type for concurrent or later processing. Data processing apparatus 24, such as a suitable computer, may perform data analysis in the field in real time. Alternatively, or in addition, recorded data may be sent to a processing center for post processing FIG. 1 is only an example. The cooling system disclosed herein may be used in a number of applications, such as wireline logging, logging-while-drilling (LWD) or measuring-while-drilling (MWD), or any other type of downhole cooling application. In LWD/MWD applications, the carrier can be a drill string.

Figure 2:
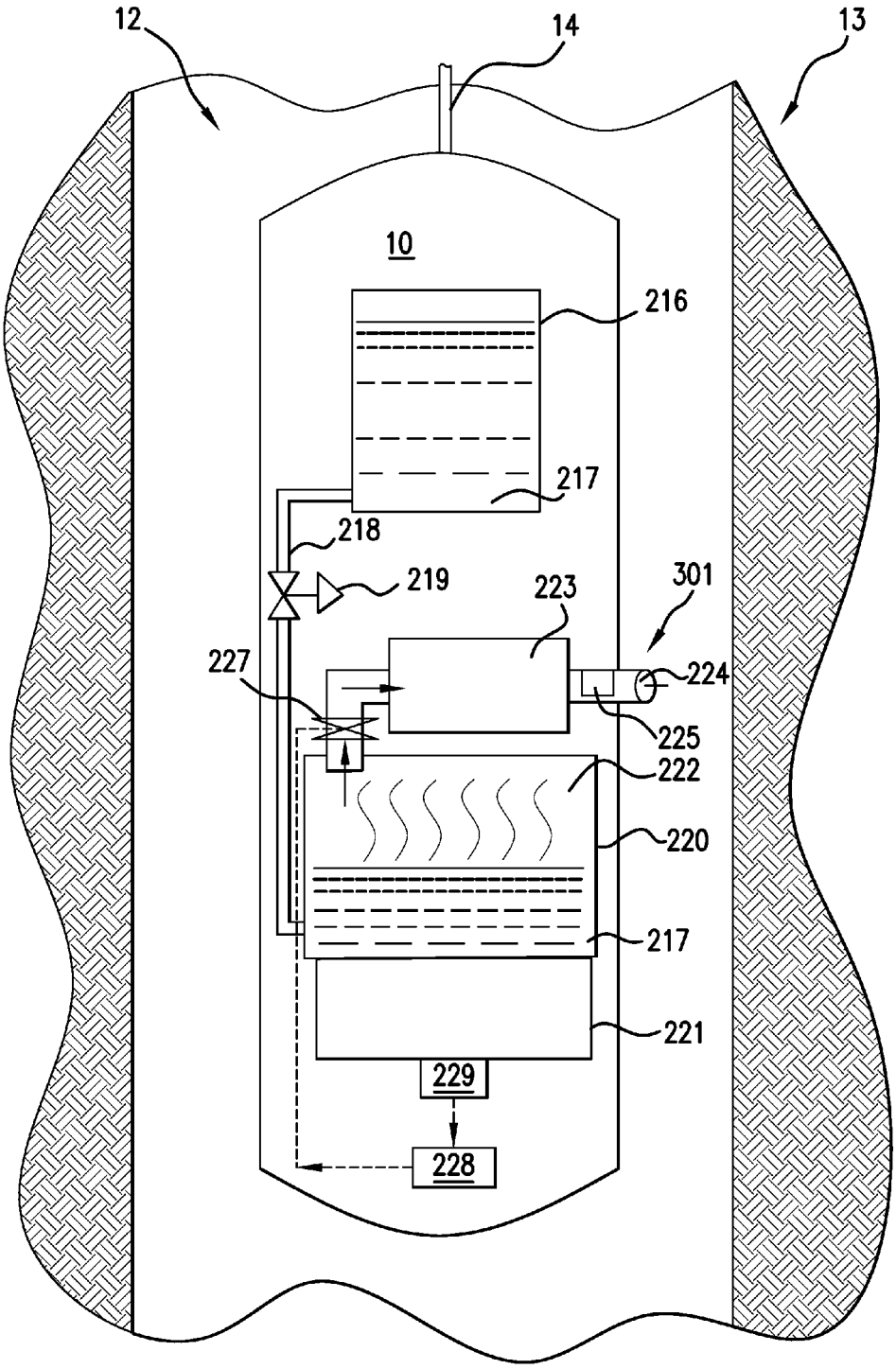
FIG. 2 illustrates a vertical section of a cooling system in one embodiment.

FIG. 2 shows a cooling system in accordance with the invention. Tool 10 is again suspended via cable 14 into borehole 12 that penetrates the earth formation 13. The cooling mechanism for tool 10 includes a reservoir 216 containing refrigerant 217. Refrigerant travels through tubing 218, which includes an optional level control valve 219 to evaporator 220, to manage the level of refrigerant and prevent the refrigerant from being totally depleted in the local reservoir (i.e., local evaporator) before the main reservoir 216, which might supply multiple local reservoirs, had been totally depleted. The evaporator 220 is in thermal communication with a downhole component 221 for the purpose of cooling that component. As refrigerant 217 absorbs heat from component 221, it forms vapor 222. The vapor 222 is removed from the evaporator using a pump 223 and released into borehole 12 at 224. Another embodiment would use a valve 227 (e.g., a pressure control valve) disposed between the vapor discharge from the evaporator 220 and the vapor pump 223 that would only release vapor to the pump 223 when that vapor's pressure exceeded some desired value. Such a valve would allow control of the rate of cooling of the component 221 by controlling the rate of refrigerant evaporation. In another embodiment, the valve 227 can be continuously controlled by a controller 228 in a feedback control loop where a temperature sensor 229 senses the temperature of the component 221 and inputs the temperature to the controller 228. Hence, the controller 228 can be setup to maintain the component 221 at a selected temperature or setpoint.

The particular configuration and relative positions of elements illustrated in FIG. 2 is optional. The skilled artisan might devise numerous other configurations as a matter of design choice without departing from the concepts of the invention. For instance, in one embodiment refrigerant can be supplied or replenished by tubing in a non-standard, specialized cable 14. Without such a specialized cable, the amount of cooling would be limited to the original total charge of refrigerant contained in the tool 10.

The expendable refrigerant is, in one embodiment, a fluid such as water. The skilled artisan may choose other refrigerants. Criteria for choosing a refrigerant might include high heat of vaporization, low toxicity, low cost, wide availability, and adaptability to conditions of temperature and pressure commonly found in the borehole. Water scores high on all these criteria. Other non-limiting embodiments of the refrigerant 217 include an alcohol (such as methanol, ethanol, n-propanol, n-butanol, 1-pentanol, 1-hexanol, 2-hexanol, 1-octanol, 2-octanol, 3-octanol, or 4-octanol) or a hydrocarbon (such as pentane, hexane, heptane, octane, nonane, or decane).

As compared with a sorption cooler, the expendable refrigerant approach could use space not used for sorbent to increase the size of reservoir 216 and for pump 223. The pump should be adapted to conditions of temperature and pressure ambient in the borehole. The pump can be of any suitable sort having the capability to discharge the pumped fluid above the ambient pressure of the borehole 12 at a depth where the tool 10 is located. As an example, if the pump 223 has a stroke force of 2100 Newtons (472 lb.), a pressure of 30,000 psi could be produced using a pump piston area of 0.0157 $in^2$. The pump 223 can be powered electrically or hydraulically. Electric or hydraulic power can be supplied from the surface of the earth, such as through the cable 14, or a local power supply, such as a battery, may be included in the tool 10.

The tool 10 can include various sensors and controls (not shown) for monitoring and controlling the cooling system. Non-limiting examples of sensors include optical sensors, chemical sensors, temperature sensors, pressure sensors, and level sensors. Non-limiting examples of controls include switch contacts, valves, and analog or digital controllers. In one or more embodiments, a temperature sensor such as a thermostat can monitor the temperature of the refrigerant 217 and actuate the pump 223 upon meeting or exceeding a set-point. In one or more embodiments, a level sensor can be configured to sense the level of the refrigerant 217 in the evaporator 220. The level sensor itself or through a controller can then control the level control valve 219 to provide a constant level of refrigerant in the evaporator 220.

In one embodiment, a check valve 225, such as the HIP 30-41HF16 that is rated to 30,000 psi, may be used to ensure that the pump only pushes fluid out to the borehole, while preventing borehole fluid from entering the tool. The HIP 30-41HF16 is available from the High Pressure Equipment Company of Erie, Pa.

Figure 3:
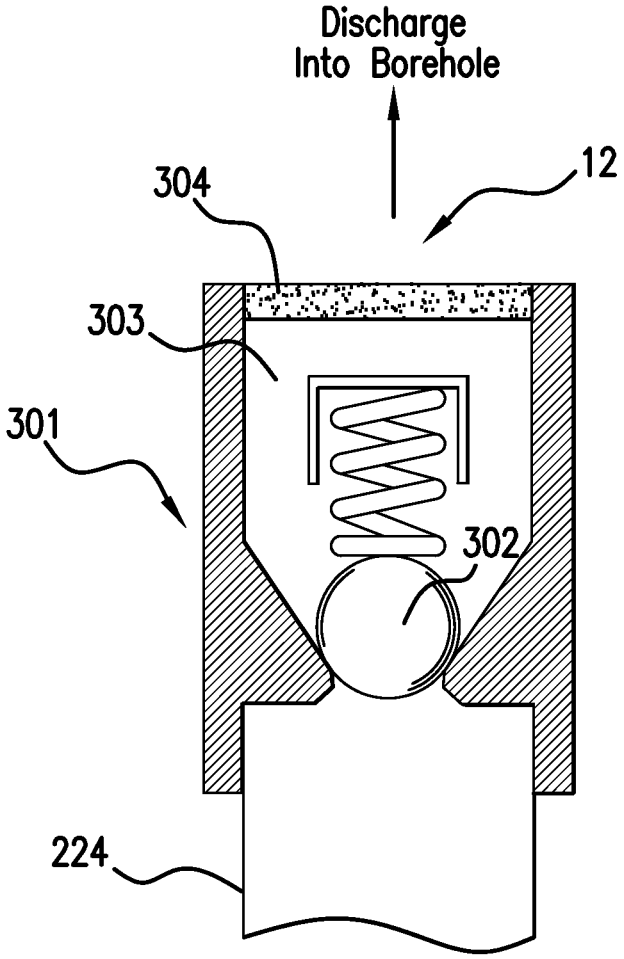
FIG. 3 illustrates a section of a check valve.

FIG. 3 is a section of a possible check valve system 301 for preventing particulates from entering the tube 224 of the cooling system of FIG. 2. Particulates in the borehole mud could prevent ball 302 from sealing. To prevent such failure, some protection for the outlet of the check valve may be included, such as submerging the outlet of the check valve in pure water 303, behind a water-wet and water-filled glass frit 304 that has some permeability. In one embodiment, as the discharged vapor/steam is forced through the pores of a frit, which has not already been completely filled with water, the water vapor undergoes capillary condensation in the frit and changes to a liquid, creating a buffer of pure water for the ball valve. Oil-based Muds ("OBM") and particulates would not be able to pass backwards through the frit and into the region of the ball valve.

It can be appreciated that the cooling system disclosed herein avoids the use of additional equipment, such as storage tanks and condensers, for storing refrigerant retrieved after cooling the downhole component. This can be advantageous in the downhole tool 10 where space can be limited.

In support of the teachings herein, various analysis components may be used, including a digital and/or an analog system. For example, the downhole tool 10, the electronic module 22, the data processing apparatus 24, or the controller 228 may include the digital and/or analog system. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

The term "carrier" as used herein means any device, device component, combination of devices, media and/or member that may be used to convey, house, support or otherwise facilitate the use of another device, device component, combination of devices, media and/or member. Other exemplary non-limiting carriers include drill strings of the coiled tube type, of the jointed pipe type and any combination or portion thereof. Other carrier examples include casing pipes, wirelines, wireline sondes, slickline sondes, drop shots, bottom-hole-assemblies, drill string inserts, modules, internal housings and substrate portions thereof.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or any combination of terms. The term "couple" relates to coupling a first component to a second component either directly or indirectly through an intermediate component.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A method for cooling a downhole component comprising:

passing an expendable refrigerant in thermal communication with the component through an evaporator;

evaporating at least a portion of the expendable refrigerant to form refrigerant vapor in order to cool the component;

conveying the refrigerant vapor from the evaporator to a borehole; and releasing the refrigerant vapor from an enclosure of the evaporator into the borehole disposed outside the evaporator enclosure.

2. The method of claim 1, wherein the component is disposed in a borehole tool.

3. The method of claim 1, wherein the component is associated with wireline logging.

4. The method of claim 1, wherein the component is associated with logging-while-drilling or measuring while drilling.

5. The method of claim 1, wherein conveying comprises pumping refrigerant vapor from the evaporator.

6. The method of claim 5, wherein conveying further comprises passing the refrigerant vapor through a fit.

7. The method of claim 6, wherein conveying further comprises passing the refrigerant vapor through a check valve.

8. The method of claim 1, further comprising controlling a level of refrigerant in the evaporator to a desired level.

9. The method of claim 1, further comprising supplying or replenishing the refrigerant from the surface of the Earth.

10. Apparatus for cooling at least one downhole component comprising: at least one evaporator in thermal communication with the at least one downhole component, the evaporator containing at least one expendable refrigerant that vaporizes responsive to heat of the at least one downhole component; and at least one element configured to remove refrigerant vapor from the at least one evaporator and release removed refrigerant from an enclosure of the evaporator into a borehole disposed outside the evaporator enclosure.

11. The apparatus of claim 10, wherein the at least one expendable refrigerant comprises water.

12. The apparatus of claim 10, wherein the at least one element comprises at least one vapor pump.

13. The apparatus of claim 10, wherein the at least one element comprises at least one check valve configured to prevent particulates from entering the apparatus from the borehole.

14. The apparatus of claim 13, wherein: the at least one check valve is submerged in the at least one refrigerant; and the element further comprises at least one frit configured to be wetted and filled by condensing the at least one refrigerant for filtering out particulates from the at least one borehole and preventing the particulates from entering the at least one check valve.

15. The apparatus of claim 14, wherein the at least one frit is configured to condense the refrigerant vapor prior to releasing the refrigerant into the at least one borehole.

16. The apparatus of claim 10, further comprising at least one downhole reservoir for storing additional expendable refrigerant, the at least one downhole reservoir being coupled to the at least one evaporator to provide the at least one expendable refrigerant to the at least one evaporator.

17. The apparatus of claim 10, further comprising at least one valve coupled to the at least one evaporator and configured to control flow of refrigerant into the at least one evaporator.

18. The apparatus of claim 10, wherein the at least one downhole component is disposed in a borehole tool.

19. The apparatus of claim 18, wherein the borehole tool is supported by a cable.

20. The apparatus of claim 19, wherein the cable is configured to supply or replenish the refrigerant.

* * * * *